US006699098B1

(12) United States Patent
Kau

(10) Patent No.: US 6,699,098 B1
(45) Date of Patent: Mar. 2, 2004

(54) ANIMATED MUSICAL ALLIGATOR

(75) Inventor: Ben Kau, 127 S. Second Ave., #C, Arcadia, CA (US) 91006

(73) Assignee: Ben Kau, Arcadia, CA (US)

( * ) Notice: Subject to any disclaimer, the term of this patent is extended or adjusted under 35 U.S.C. 154(b) by 0 days.

(21) Appl. No.: 10/224,225

(22) Filed: Aug. 20, 2002

(51) Int. Cl.[7] ..... H63H 3/28
(52) U.S. Cl. ..... 446/298; 446/268
(58) Field of Search ..... 446/268, 297, 446/298, 300, 301, 303, 330, 352, 353, 355, 356, 358, 368, 376, 377, 397, 158, 337, 299

(56) References Cited

U.S. PATENT DOCUMENTS 1,187,659 A * 6/1916 Savage ..... 446/356
2,329,564 A * 9/1943 Thomas ..... 446/158
3,199,248 A * 8/1965 Suzuki ..... 446/299
3,808,734 A * 5/1974 Suzuki ..... 446/158
5,279,514 A * 1/1994 Lacombe et al. ..... 446/297

* cited by examiner

*Primary Examiner*—Derris H. Banks
*Assistant Examiner*—Bena B. Miller

(57) ABSTRACT

This invention relates to an animated musical alligator which features movement while playing music. The object of the animated musical alligator is to provide an original, amusing toy and novelty item for adults and children, alike. When it plays songs, mouth movements occur in synchronization with the singing, as a result of its circuitry and mechanical operation system. In addition, the alligator produces realistic walking movements and up-and-down, as well as side-to-side head movements. The invention's integrated circuit, which creates sound signal and movement signal outputs, produces music through its amplifier and speaker. Additionally, the IC activates various motors, which trigger gears to create leg movements and side-to-side and up-and-down head movements. This operation system also creates mouth movements in synchronization with the playing of songs.

2 Claims, 4 Drawing Sheets

ANIMATED MUSICAL ALLIGATOR

BACKGROUND

1. Field of Invention

This invention relates to an animated musical alligator which features movement while playing music. When it plays songs, mouth movements occur in synchronization with the singing, as a result of its circuitry and mechanical operation system. In addition, the alligator produces realistic walking movements and up-and-down, as well as side-to-side head movements.

2. Description of Prior Art

Often, novelty items manufactured for the purpose of play or entertainment may produce music or include some movement by characters that the items may showcase. However, such products lack true entertainment value because their features are too predictable. In contrast, the animated musical alligator combines a variety of different functions to create an attractive and captivating novelty item that will appeal to individuals of all ages.

OBJECTS AND ADVANTAGES

The object of the animated musical alligator is to provide an original, amusing toy and novelty item for adults and children, alike. The advantages of the invention are its combination of entertaining functions. These functions operate by means of the alligator's circuitry and mechanical operation system:

1) The alligator can play music and initiate mouth movements in synchronization with songs that it plays.
2) The alligator produces realistic walking movements.
3) The alligator can create head movements consisting of a swaying action from side to side, as well as an up-and-down action.

SUMMARY

This invention consists of an animated musical alligator designed to provide an interesting and unusual toy and novelty item for adults and children to enjoy. By means of its intriguing combination of functions, the alligator offers an especially attractive and unique type of entertainment. The invention can produce mouth movements in synchronization with the singing, as a result of its circuitry and mechanical operation system. In addition, the alligator produces realistic walking movements and up-and-down, as well as side-to-side head movements.

DRAWINGS

Drawing Figures

Figure 1:
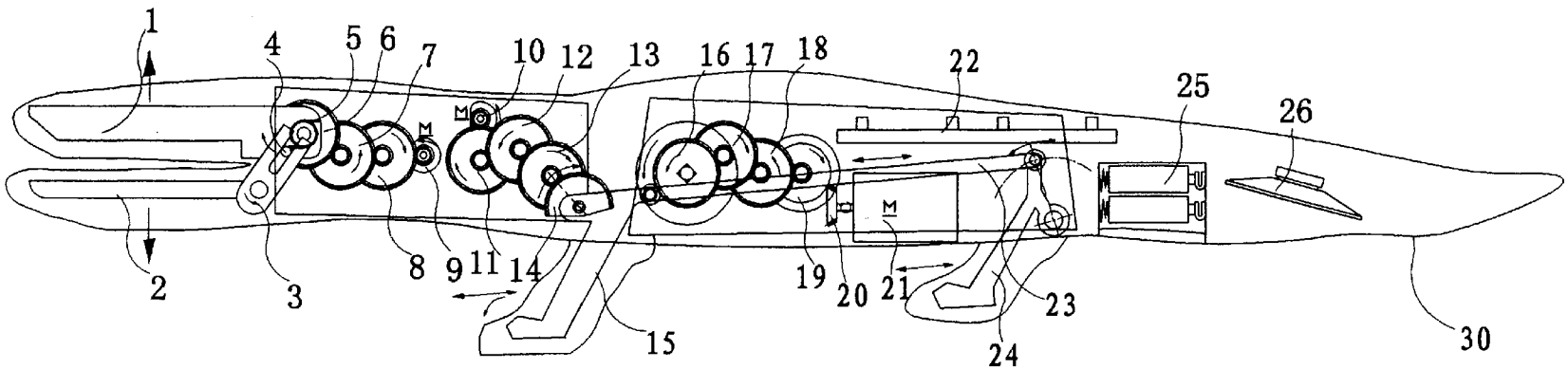

The following numbers correspond to specific drawings of the invention:

FIG. 1 provides an overall view of the invention's mechanism

Figure 2:
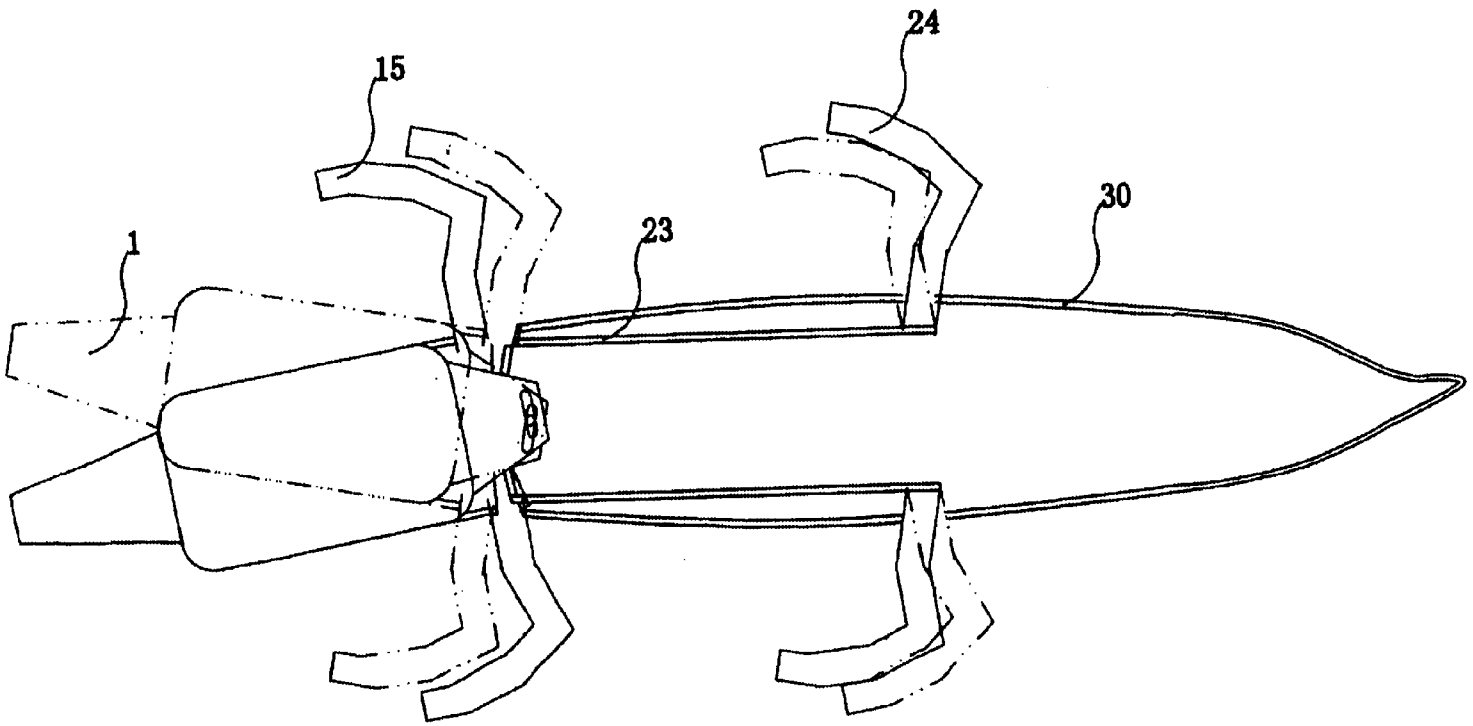
Figure 3:
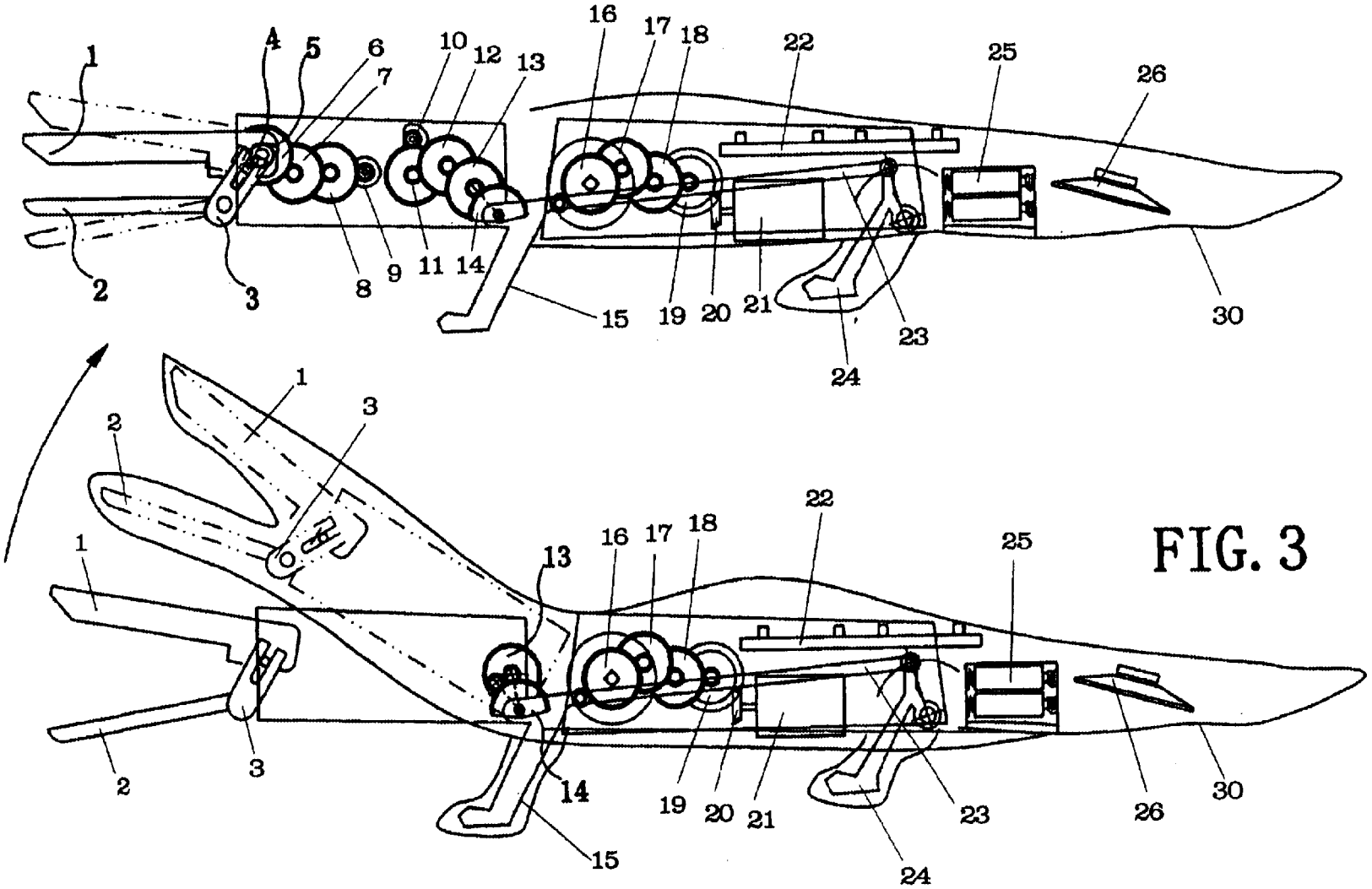
Figure 4:
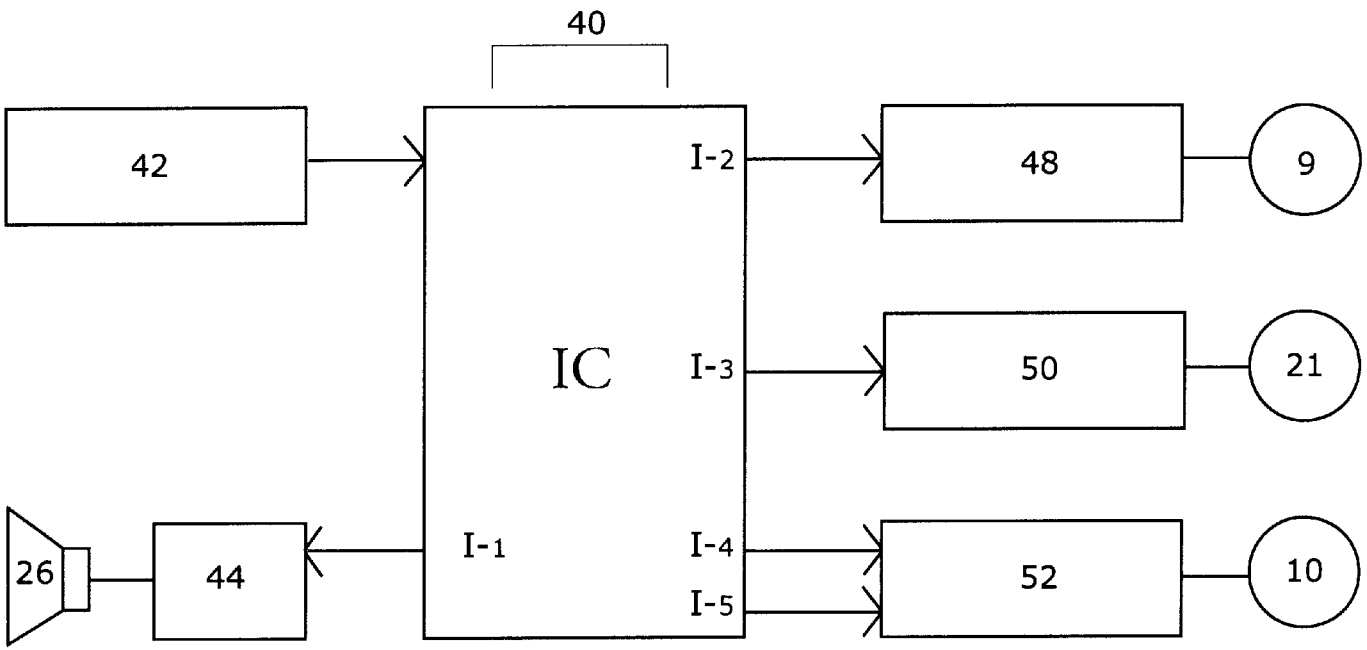

FIG. 2 shows a view of the invention from above, featuring its head and leg movements FIG. 3 offers a view of the invention's driving mechanism FIG. 4 shows a block diagram of the invention

REFERENCE NUMERALS IN DRAWINGS

1 alligator's upper jaw
2 alligator's lower jaw
3 lever

4 eccentric gear
5 twisting spring
6 gear
7 gear
8 gear
9 motor
10 motor
11 gear
12 gear
13 gear
14 fan-shaped gear
15 foreleg
16 eccentric gear
17 gear
18 gear
19 gear
20 gear
21 motor
22 circuit board
23 lever
24 hind leg
25 batteries
26 speaker
30 alligator
40 IC
42 trigger circuit
44 amplifier
48 driving circuit
50 driving circuit
52 driving circuit

DETAILED DESCRIPTION

Description of Preferred Embodiments and Operation of Invention

IC 40 is an integrated circuit that creates sound signal output and movement signal output. It is driven by trigger circuit 42. I-1 is connected to an amplifier 44, producing sound through a speaker 26. I-2 is connected to driving circuit 48 to drive motor 9 so that mouth movements are produced in synchronization with the sound that is created. I-3 is connected to driving circuit 50 to drive motor 21, causing the alligator's leg movements. I-4 and I-5 are connected to driving circuit 52, activating motor 10 to cause the alligator's head to move up and down.

(A) Mouth movements: When electrified, motor 9 rotates and decelerates through gears 8 and 7 to drive gear 6 and eccentric gear 4 to cause the alligator's upper jaw 1 to raise upward. At the same time, eccentric gear 4 drives lever 3 to turn around so that the alligator's lower jaw 2 moves downward. When power is cut off, twisting spring 5 pulls the upper jaw 1 and lower jaw 2 back to their original positions.

(B) Leg and side-to-side head movements: When electrified, motor 21 decelerates through gears 19, 18, and 17 to drive eccentric gear 16 to rotate, so that lever 23 will move back and forth. This action, in turn, drives foreleg 15 and hind leg 24 to move forward. Since eccentric gear 16 is not symmetrical, the head sways from right to left as a result of the motion of eccentric gear 16.

(C) Up-and-down head movements: When electrified, motor 10 rotates, decelerating through gears 11, 12, and 13. Since fan-shaped gear 14 is fixed, gear 13 turns around it, causing the alligator's head to raise up. When the music that the alligator plays has ended, motor 10 reverses to return the alligator's head to its original position.

CONCLUSION

In conclusion, this invention is designed to create an unusual and amusing novelty item that is highly entertaining for adults and children, alike. The invention accomplishes this goal by means of its circuitry and mechanical system. The invention's integrated circuit, which creates sound signal and movement signal outputs, produces music through its amplifier and speaker. Additionally, the IC activates various motors, which trigger gears to create leg movements and side-to-side and up-and-down head movements. Finally, mouth movements are created in synchronization with the playing of songs.

I claim:

1. An animated musical reptilian figure comprising, in combination, a body, a head, a tail and appendages connected to said body; wherein said figure is capable of playing music, said figure having a circuitry system including an integrated circuit; said integrated circuit creating a sound signal output and being driven by a trigger circuit, said body also including an amplifier and a speaker wherein said amplifier and said speaker is connected to said integrated circuit; said integrated circuit activates said amplifier wherein said amplifier produces a sound through said speaker; said integrated circuit also producing a movement signal output activating a driving circuit; said driving circuit drives a first motor connected to a first set of gears to move the mouth of the reptilian in synchronization with said sound produced by said integrated circuit, said integrated circuit also providng a movement signal output activating a second driving circuit; said second drives a second motor connected to a second set of gears and an eccentric gear to move said tail and appendages of the reptilian figure; said integrated circuit also producing a movement signal output activating a third driving circuit, said third driving circuit driving a third motor connected to a third set of gears to move said head of said reptilian figure to produce head movements in said reptilian figure.

2. An animated musical reptilian figure, as claimed in claim 1, further comprising a lever connected to said eccentric gear, wherein movements of said appendages are created when said second motor decelerates through said second set of gears to drive said eccentric gear to rotate and activate said lever, thereby producing movement of the appendages of said reptilian figure; the rotation of said eccentric gear causing said tail of said reptilian figure to sway from side to side.

* * * * *